US009865392B2

(12) United States Patent
Groves et al.

(10) Patent No.: US 9,865,392 B2
(45) Date of Patent: Jan. 9, 2018

(54) SOLENOIDAL SERIES STACKED MULTIPATH INDUCTOR

(71) Applicant: GLOBALFOUNDRIES INC., Grand Cayman (KY)

(72) Inventors: Robert A. Groves, Highland, NY (US); Venkata Nr. Vanukuru, Bangalore (IN)

(73) Assignee: GLOBALFOUNDRIES INC., Grand Cayman (KY)

( * ) Notice: Subject to any disclaimer, the term of this patent is extended or adjusted under 35 U.S.C. 154(b) by 323 days.

(21) Appl. No.: 14/304,564

(22) Filed: Jun. 13, 2014

(65) Prior Publication Data

US 2015/0364241 A1 Dec. 17, 2015

(51) Int. Cl.

| | |
|---|---|
| ***H01F 27/28*** | (2006.01) |
| ***H01F 5/00*** | (2006.01) |
| ***H01F 41/04*** | (2006.01) |
| ***H01F 17/00*** | (2006.01) |

(52) U.S. Cl.

CPC ..... *H01F 41/041* (2013.01); *H01F 17/0033* (2013.01); *H01F 2017/0053* (2013.01)

(58) Field of Classification Search

CPC ..... H01F 41/041

USPC ..... 336/200

See application file for complete search history.

(56) References Cited

U.S. PATENT DOCUMENTS

| | | | | |
|---|---|---|---|---|
| 5,559,360 | A * | 9/1996 | Chiu | H01F 17/0006 257/531 |
| 6,549,112 | B1 | 4/2003 | Gallina et al. | |
| 6,798,039 | B1 * | 9/2004 | Gillespie | H01F 17/0006 257/508 |
| 6,972,658 | B1 * | 12/2005 | Findley | H01F 17/0006 257/531 |

(Continued)

FOREIGN PATENT DOCUMENTS

| | | | |
|---|---|---|---|
| JP | 06061071 | A | 3/1994 |
| JP | 02003257740 | A | 9/2003 |
| WO | WO2009128047 | A1 | 10/2009 |

OTHER PUBLICATIONS

Athreya, D., et al. "Ultra High Q Embedded Inductors in Highly Miniaturized Family of Low Loss Organic Substrates" 2008 Electronic Components and Technology Conference. May 2008. pp. 2073-2080.

(Continued)

*Primary Examiner* — Elvin G Enad
*Assistant Examiner* — Ronald Hinson
(74) *Attorney, Agent, or Firm* — Anthony Canale; Hoffman Warnick

(57) ABSTRACT

A series stacked, solenoidally wound, multipath inductor includes a plurality of turns disposed about a center region on two layers. The turns on the two layers have corresponding geometry therebetween. Each of the plurality of turns includes two or more segments that extend length-wise along the turns. The segments have positions that vary from an innermost position relative to the center region and an (Continued)

outermost position relative to the center region. A cross-over architecture is configured to couple the segments of a turn on one layer with the segments on a turn on another layer to form segment paths that have a substantially same length for all segment paths in a segment path grouping between the two layers.

21 Claims, 12 Drawing Sheets

(56) References Cited

U.S. PATENT DOCUMENTS

| | | | | |
|---|---|---|---|---|
| 7,312,685 | B1 * | 12/2007 | Lee | H01F 17/0013 336/200 |
| 7,370,403 | B1 * | 5/2008 | Hsu | H01F 17/0006 29/602.1 |
| 7,902,953 | B1 | 3/2011 | Watt | |
| 8,302,287 | B2 | 11/2012 | Lu et al. | |
| 8,325,001 | B2 | 12/2012 | Huang et al. | |
| 8,358,192 | B2 | 1/2013 | Kireev et al. | |
| 8,505,193 | B2 | 8/2013 | Papananos | |
| 2004/0017278 | A1 * | 1/2004 | Castaneda | H01F 17/0006 336/200 |
| 2009/0273429 | A1 | 11/2009 | Nakamura et al. | |
| 2011/0133877 | A1 | 6/2011 | Chiu et al. | |
| 2013/0200969 | A1 | 8/2013 | Singh et al. | |
| 2013/0200976 | A1 | 8/2013 | Singh et al. | |
| 2013/0328164 | A1 * | 12/2013 | Cheng | H01L 28/10 257/531 |

OTHER PUBLICATIONS

Bae, H., et al. "Cost Effective Parallel-Branch Spiral Inductor With Enhanced Quality Factor and Resonance Frequency" 2007 Topical Meeting on Silicon Monolithic Integrated Circuits in RF Systems. Jan. 2007. pp. 87-90.

Belfiore, G., et al. "New Design Approach of Vertical Inductors for High-Frequency Integrated Circuits" 2013 SBMO/IEEE MTT-S International Microwave & Optoelectronics Conference (IMOC). Aug. 2013. (4 Pages).

Cai, H., et al. "Application of Ferrite Nanomaterial in RF On-Chip Inductors" Journal of Nanomaterials, vol. 2013. (Apr. 2013) pp. 1-12.

Chen, J., et al. "On-Chip Spiral Inductors for RF Applications: An Overview" Journal of Semiconductor Technology and Science, vol. 4, No. 3. Sep. 2004. pp. 149-167.

Chen, W., et al. "Three-Dimensional Fully Symmetric Inductors, Transformer, and Balun in CMOS Technology" IEEE Transactions on Circuits and Systems—I. Regular Papers, vol. 54, No. 7. Jul. 2007. pp. 1413-1423.

Huang, W., et al. "On-Chip Inductors With Self-Rolled-Up SINx Nanomembrane Tubes: A Novel Design Platform for Extreme Miniaturization" Nano Letters. Nov. 2012. pp. 6283-6288.

Islam, A., et al. "Design and Optimization of Printed Circuit Board Inductors for Wireless Power Transfer System" Circuits and Systems, vol. 4. Nov. 2012. pp. 237-244.

Lopez-Villegas, J., et al. "Improvement of the Quality Factor of RF Integrated Inductors by Layout Optimization" IEEE Transactions on Microwave Theory and Techniques, vol. 48, No. 1. Jan. 2000. pp. 76-83.

Maruyama, T., et al. "Increase of Q-Factor of RF Magnetic Thin Film Inductor by Introducing Slit-Patterned Magnetic Thin Film and Multiline-Conductor Spiral Coil" IEEE Transactions on Magnetics, vol. 47, No. 10. Oct. 2011. pp. 3196-3199.

Tang, C., et al. "Miniature 3-D Inductors in Standard CMOS Process" IEEE Journal of Solid-State Circuits, vol. 7=37, No. 4. Apr. 2002. pp. 471-480.

Tiemeijer, L., et al. "Record Q Spiral Inductors in Standard CMOS" International Electron Devices Meeting, 2001. IEDM '01. Technical Digest. Dec. 2001. pp. 40.7.1-40.7.3.

Wu, C., et al. "Selective Metal Parallel Shunting Inductor and Its VCO Application" IEEE Transactions on Circuits and Systems—I: Regular Papers, vol. 52, No. 9. Sep. 2005. pp. 1811-1818.

Xu, X., et al. "Design of Novel High-Q-Factor Multipath Stacked On-Chip Spiral Inductors" IEEE Transactions on Electron Devices, vol. 59, No. 8. Aug. 2012. pp. 2011-2018.

Yin, W., et al. "Double-Level Spiral Inductors With Multiple-Via Interconnects on GAAS Substrates" IEEE Transactions on Magnetics, vol. 40, No. 3. May 2004. pp. 1756-1758.

Zolfaghari, A., et al. "Stacked Inductors and Transformers in CMOS Technology" IEEE Journal of Solid-State Circuits, vol. 36, No. 4. Apr. 2001. pp. 620-628.

Groves, R., et al. "Solenoidal Series Stacked Multipath Inductor" U.S. Appl. No. 14/242,397, filed Apr. 1, 2014. (41 Pages).

* cited by examiner

SOLENOIDAL SERIES STACKED MULTIPATH INDUCTOR

RELATED APPLICATION DATA

This application is related to commonly assigned application Ser. No. 14/304,598 filed concurrently herewith and incorporated herein by reference.

BACKGROUND

Technical Field

The present invention relates to integrated circuits, and more particularly to three-dimensional integrated circuit inductor structures configured with reduced capacitance and reduced skin and proximity effects for high frequency applications.

Description of the Related Art

With an increased demand for personal mobile communications, integrated semiconductor devices such as complementary metal oxide semiconductor (CMOS) devices may, for example, include voltage controlled oscillators (VCO), low noise amplifiers (LNA), tuned radio receiver circuits, or power amplifiers (PA). Each of these tuned radio receiver circuits, VCO, LNA, and PA circuits may, however, require on-chip inductor components in their circuit designs.

Several design considerations associated with forming on-chip inductor components may, for example, include quality factor (i.e., Q-factor), self-resonance frequency ($f_{SR}$), and cost considerations impacted by the area occupied by the formed on-chip inductor. Accordingly, for example, a CMOS radio frequency (RF) circuit design may benefit from, among other things, one or more on-chip inductors having a high Q-factor, a small occupied chip area, and a high $f_{SR}$ value. The $f_{SR}$ of an inductor may be given by the following equation:

$$f_{SR} = \frac{1}{2\pi\sqrt{LC}},$$

where L is the inductance value of the inductor and C may be the capacitance value associated with the inductor coil's inter-winding capacitance, the inductor coil's interlayer capacitance, and the inductor coil's ground plane (i.e., chip substrate) to coil capacitance. From the above relationship, a reduction in capacitance C may desirably increase the $f_{SR}$ of an inductor. One method of reducing the coil's ground plane to coil capacitance (i.e., metal to substrate capacitance) and, therefore, C value, is by using a high-resistivity semiconductor substrate such as a silicon-on-insulator (SOI) substrate. By having a high resistivity substrate (e.g., >50 Ω-cm), the effect of the coil's metal (i.e., coil tracks) to substrate capacitance is diminished, which in turn may increase the $f_{SR}$ of the inductor. Reducing the inductor coil's inter-winding and interlayer capacitance can similarly increase the $f_{SR}$ of the inductor.

The Q-factor of an inductor at frequencies well below $f_{SR}$ may be given by the equation:

$$Q = \frac{\omega L}{R},$$

where ω is the angular frequency, L is the inductance value of the inductor, and R is the resistance of the coil. As deduced from the above relationship, a reduction in coil resistance may lead to a desirable increase in the inductor's Q-factor. For example, in an on-chip inductor, by increasing the turn-width (i.e., coil track width) of the coil, R may be reduced in favor of increasing the inductors Q-factor to a desired value. In radio communication applications, the Q-factor value is set to the operating frequency of the communication circuit. For example, if a radio receiver is required to operate at 2 GHz, the performance of the receiver circuit may be optimized by designing the inductor to have a peak Q frequency value of about 2 GHz. The $f_{SR}$ and Q-factor of an inductor are directly related in the sense that by increasing $f_{SR}$, peak Q is also increased.

Skin effect is the tendency for high-frequency currents to flow on the surface of a conductor. Proximity effect is the tendency for current to flow in other undesirable patterns, e.g., loops or concentrated distributions, due to the presence of magnetic fields generated by nearby conductors. In transformers and inductors, proximity effect losses typically dominate over skin effect losses. Proximity and skin effects significantly complicate the design of efficient transformers and inductors operating at high frequencies.

In radio frequency tuned circuits used in radio equipment, proximity and skin effect losses in the inductor reduce the Q factor. To minimize this, special construction is used in radio frequency inductors. The winding is usually limited to a single layer, and often the turns are spaced apart to separate the conductors. In multilayer coils, the successive layers are wound in a crisscross pattern to avoid having wires lying parallel to one another.

SUMMARY

A series stacked, solenoidally wound, multipath inductor includes a plurality of turns disposed about a center region on two layers. The turns on the two layers have corresponding geometry therebetween. Each of the plurality of turns includes two or more segments that extend length-wise along the turns. The segments have positions that vary from an innermost position relative to the center region and an outermost position relative to the center region. A cross-over architecture is configured to couple the segments of a turn on one layer with the segments on a turn on another layer to form segment paths that have a substantially same length for all segment paths in a segment path grouping between the two layers.

A series stacked, solenoidally wound, multipath inductor includes a first metal layer being patterned to form spiral turns about a center region, the spiral turns including two or more segments that extend length-wise along the turns and having positions that vary from an innermost position relative to the center portion and an outermost position relative to the center portion. A second metal layer is patterned to form spiral turns about the center region and being vertically offset from the first metal layer. The spiral turns include two or more segments that extend length-wise along the turns and having positions that vary from an innermost position relative to the center portion and an outermost position relative to the center portion. The first layer and the second layer include corresponding geometry therebetween. At least one cross-over architecture is configured to couple the segments of the first layer to the segments of the second layer to form segment paths that have a substantially same length for all segment paths in a segment path grouping between the first layer and the second layer.

A method for fabricating a series stacked multipath inductor includes patterning a first metal layer to form spiral turns about a center region, the spiral turns including two or more segments that extend length-wise along the turns and having positions that vary from an innermost position relative to the center portion and an outermost position relative to the center portion; forming at least one cross-over architecture configured to couple the segments of the first layer to the segments of a second layer to form segment paths that have a substantially same length for all segment paths in a segment path grouping between the first layer and the second layer; and patterning the second metal layer to form spiral turns about the center region, the second metal layer being vertically offset from the first metal layer, the spiral turns including two or more segments that extend length-wise along the turns and having positions that vary from an innermost position relative to the center portion and an outermost position relative to the center portion, the first layer and the second layer including corresponding geometry therebetween.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

Figure 1:
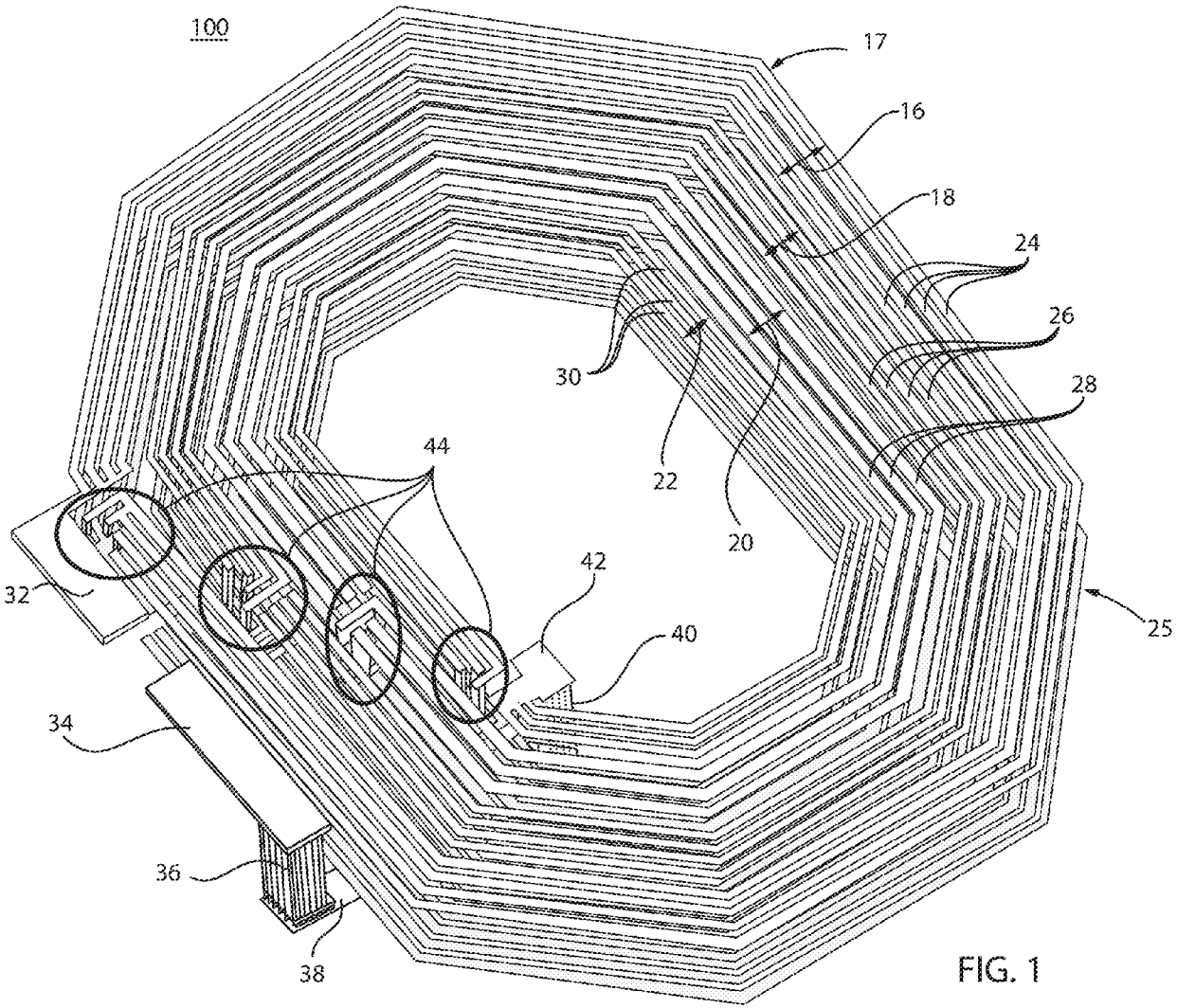
FIG. 1 is a perspective view of an illustrative solenoidal series stacked multipath inductor in accordance with the present principles.

In accordance with the present principles, structures and methods for forming structures are disclosed for three-dimensional (3D) inductors. The 3D inductors are preferably included on or with integrated circuits and more specifically may be formed on or in semiconductor devices. In particularly useful embodiments, the 3D inductors are employed in high speed applications, such as on or in radiofrequency (RF) devices and the like. In one embodiment, a 3D inductor structure includes an upper layer and one or more lower layers, which form paired spirals of upper and immediately adjacent lower lines. Each spiral is divided into multiple segments. In some embodiments, the number and/or size of segments is reduced from outer turn to inner turn.

The spirals employ a cross-over architecture, occurring one or more times per turn, to equalize the current flow through each segment. This is achieved by ensuring that the length of combined segments on different levels have a same overall length. The cross-over architecture is employed on multiple metal levels to enable lateral connections of segments without shorting segments together. The spirals are connected in a solenoidal manner. Solenoidal refers to having turns that are solenoidally wound, to reduce inter-winding capacitance, such that serially connected pairs of turns are realized on vertically adjacent levels, with each vertically adjacent pair of turns having a smaller radius than the previous pair as the spiral is wound from an outer edge toward the center through the two or more vertical layers.

Inductor structures for increased density with reduced capacitance, skin and proximity effect losses are provided in accordance with the present principles, for higher frequency operation. The inductor structures permit high frequency operation, through capacitance reduction, while retaining features of higher inductance density and reduced skin and proximity effect losses. Overall, the disclosed inductor achieves a superior figure of merit as compared to conventional structures.

The inductor structures in accordance with the present principles include a solenoidal series stacked winding for increased inductance density where spiral turns are divided into multiple strands or segments and interlevel cross-overs are provided to steer the current in such a way that all the path lengths are made equal to reduce skin and proximity effect losses. Moreover, the nature of the winding permits variable width and spacing for both the turns and segments, which further reduces the proximity effect losses. The structures described herein may be employed with other structures, such as patterned ground shields, magnetic materials, etc.

It is to be understood that the present invention will be described in terms of a given illustrative architecture implemented on semiconductor substrates; however, other architectures, structures, substrate materials and process features and steps may be varied within the scope of the present invention. For example, the two-layered solenoidal series stacked multipath inductor structure described here can be extended to three or more layers for increased inductance density. The terms coils, inductors and windings may be employed interchangeably throughout the disclosure. It should also be understood that these structures may take on any useful shape including rectangular, circular, oval, square, polygonal, etc.

It will also be understood that when an element such as a layer, region or substrate is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

A design for an integrated circuit chip in accordance with the present principles may be created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer may transmit the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

Methods as described herein may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multichip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Referring now to the drawings in which like numerals represent the same or similar elements and initially to FIG. 1, a series stacked multipath inductor 10 is illustratively shown having two levels 17 and 25. The two levels 17, 25 will be referred to as upper and lower levels for ease of explanation, it should be understood that the levels may be provided in any orientation (e.g., reversed, vertically disposed, etc.) and still function in accordance with the present principles.

The upper level or layer 17 is illustratively depicted having turns 16, 18, 20 and 22. Each turn 16, 18, 20 and 22 includes one or more segments (or strands) 24, 26, 28 and 30. In the illustrative embodiments shown, the outermost turn 16 includes four segments 24. The next turn 18 includes four segments 26. The next turn 20 includes three segments 28. The innermost turn 22 includes three segments 30. In one embodiment, the amount of conductive material increases for each turn and/or segment as radius or distance from a center of the device 10 increases. This may include adding additional segments or strands or making the strands larger (wider or thicker) or both.

The device 10 includes pads 32 and 34, which connect to end portions of the coil or device 10. The pad 34 is connected to a conductive structure 38 by a via 36. The conductive structure 38 may be placed on a different metal layer than the lower level 25. The conductive structure 38 connects to a pad 42 by a via 40.

The lower level or layer 25 includes a corresponding turn and segment structure as that or the upper layer 17. For this embodiment, the turns 16, 18, 20 and 22 and segments (or strands) 24, 26, 28 and 30 have a corresponding structure on the lower layer 25. The upper level 17 and the lower level 25 are connected using a cross-over architecture 44. The cross-over architecture 44 provides a transition to provide equal lengths for segment pairs between the upper and lower levels 17, 25. Since the segments on an inside of a coil are smaller in length than the segments of the outer portion of the coil, the cross-over architecture 44 connects segment pairs to provide equal lengths of segment pairs between levels, e.g., a longest segment on the upper level to a shortest segment on the lower level, and the shortest segment on the upper level to the longest segment on the lower level. Long intermediary segments on the upper level are connected to short intermediary segments on the lower level, and short intermediary segments on the upper level are connected to long intermediary segments on the lower level. In this way, a total length of each segment pair is equal. The cross-over architectures 44 may occur one or more times per turn.

Figure 2A:
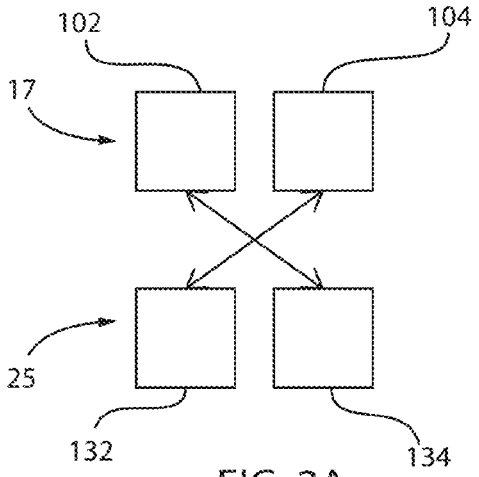
FIG. 2A is a cross-section diagram showing segment connections for turns with two segments in accordance with the present principles.
Figure 2B:
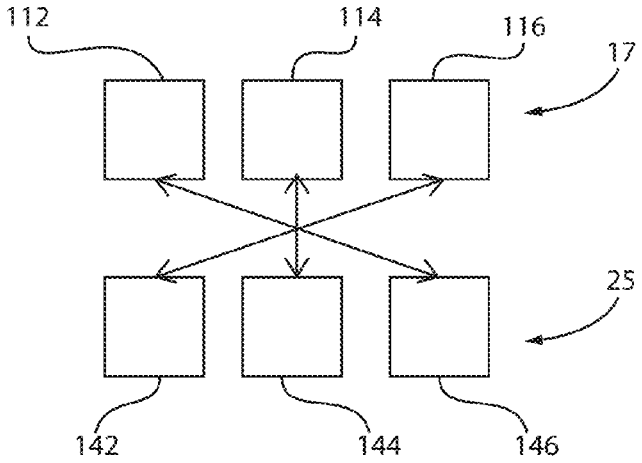
FIG. 2B is a cross-section diagram showing segment connections for turns with three segments in accordance with the present principles.
Figure 2C:
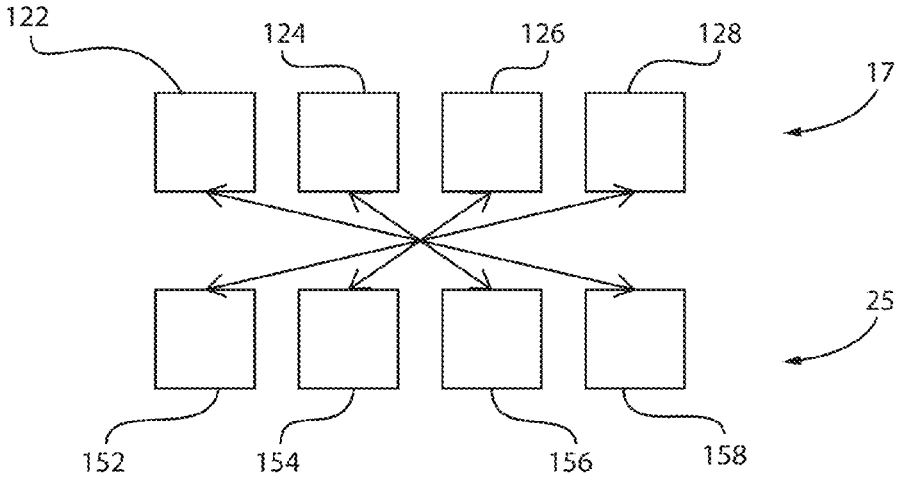
FIG. 2C is a cross-section diagram showing segment connections for turns with four segments in accordance with the present principles.

Referring to FIGS. 2A-2C, cross-section diagrams show possible connection schemes for a two layer series inductor coil in accordance with illustrative embodiments. FIG. 2A shows a cross-sectional view of a two segment turn having two segments 102 and 104 on level 17 and two segments 132 and 134 on a level 25. The segment 102 (e.g., outermost segment on level 17) is connected to segment 134 (e.g., the innermost segment on level 25) to form a segment pair. The segment 104 (e.g., innermost segment on level 17) is connected to segment 132 (e.g., the outermost segment on level 25) to form another segment pair. The two segment pairs include the same length.

FIG. 2B shows a cross-sectional view of a three segment turn having three segments 112, 114 and 116 on level 17 and three segments 142, 144 and 146 on a level 25. The segment 112 (e.g., outermost segment on level 17) is connected to segment 146 (e.g., the innermost segment on level 25) to form a segment pair. The intermediary segments 114 and 144 on levels 17 and 25 respectively are connected to form another segment pair. The segment 116 (e.g., innermost segment on level 17) is connected to segment 142 (e.g., the outermost segment on level 25) to form another segment pair. The three segment pairs include the same length.

FIG. 2C shows a cross-sectional view of a four segment turn having four segments 122, 124, 126 and 128 on level 17 and four segments 152, 154, 156 and 158 on a level 25. The segment 122 (e.g., outermost segment on level 17) is connected to segment 158 (e.g., the innermost segment on level 25) to form a segment pair. An outer intermediary segment 124 on level 17 connects to an inner intermediary segment 156 on level 25 to form another segment pair. An inner intermediary segment 126 on level 17 connects to an outer intermediary segment 154 on level 25 to form another segment pair. The segment 128 (e.g., innermost segment on level 17) is connected to segment 152 (e.g., the outermost segment on level 25) to form another segment pair. The four segment pairs include the same length. While illustrative configurations are shown for two, three and four segments, a greater number of segments is contemplated as well in accordance with the present principles.

Figure 3:
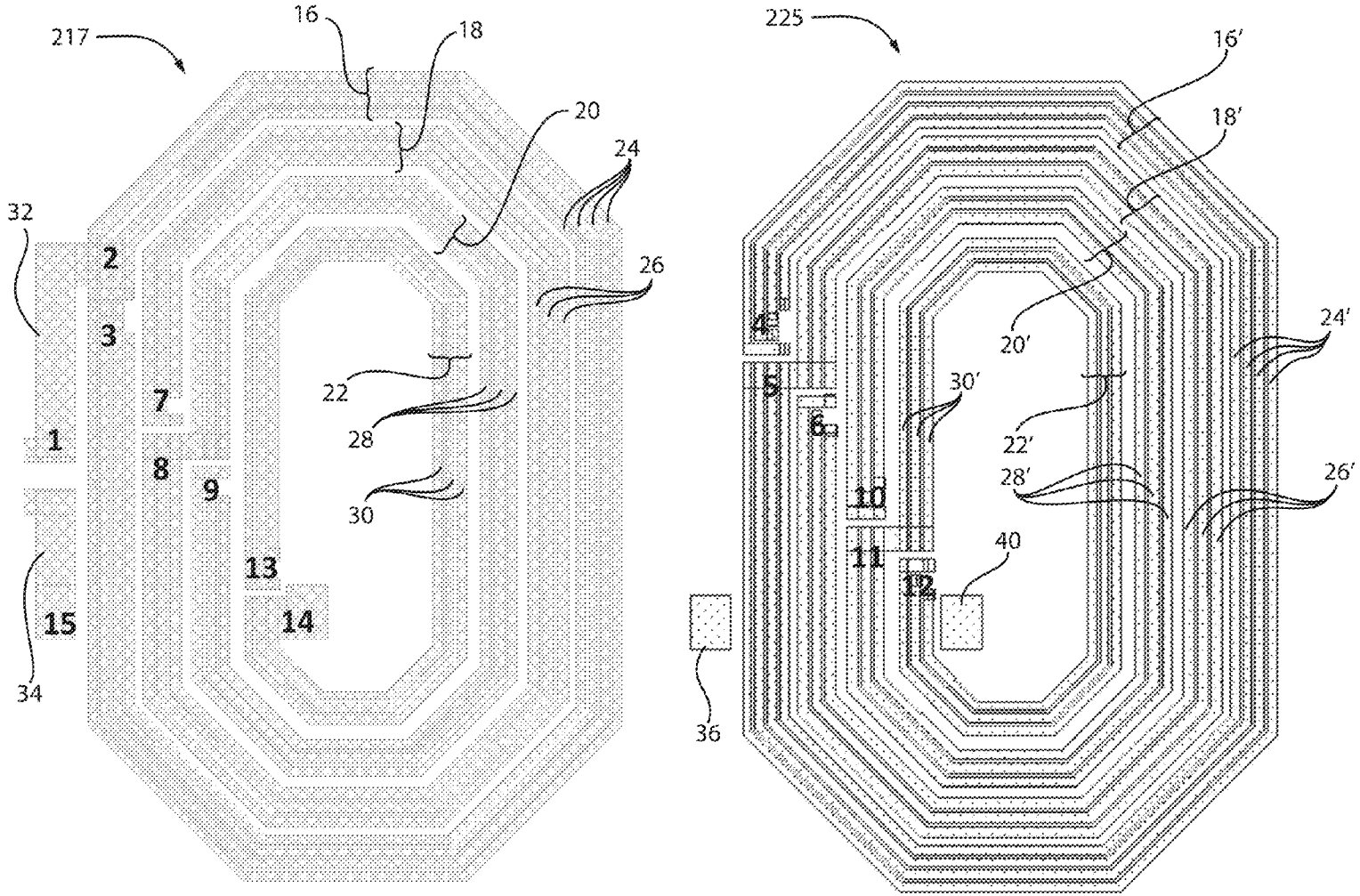
FIG. 3 is a layout view showing two spirals and interlevel connection points where cross-over architectures are employed therebetween in accordance with the present principles.

Referring to FIG. 3, a layout view is shown for a top spiral 217 (level 17) and a bottom spiral 225 (level 25) in accordance with an illustrative embodiment. The layout view shows an example of corresponding layers of a two-level structure; however, it should be understood that additional levels may be employed, and the additional levels may include cross-over architectures to maintain common lengths between segments. The segments in such a case may be pairs, triplets, quadruplets, etc. that extend between two, three, four, etc. levels.

In the top spiral 217, a first connection point 1 connects to connection point 2, which connects all four segments 24. The segments 24 form a turn that extends to connection point 3. Connection point 3 includes a cross-over architecture connection to levels 225 connecting at point 4. Segments 24' of turn 16' connect to connection point 5 which connects segments 24' to segments 26' of turn 18'.

At connection point 5, the radius of the next turn is decreased. To make the connection between point 5 and the next turn, a turn-to-turn connection is needed. FIGS. 4A-4D show four illustrative possibilities for making the turn-to-turn connection at point 5. Connection point 5 continues around turn 18' to point 6. Point 6 is a cross-over point having a cross-over architecture, which connects to point 7 on level 217. Point 7 connects to point 8 through turn 18, where another turn-to-turn connection point is employed to connect turn 20 to point 9. Point 9 is a cross-over point having a cross-over architecture that connects with point 10 of level 225. Point 10 is connected to point 11 through turn 20' (segments 28'). Segments 28' of turn 20' connect to connection point 11, which connects through another turn-to-turn connection to segments 30' of turn 22' to point 12. Point 12 is a cross-over point having a cross-over architecture that connects with point 13 of level 217. Point 13 is connected to point 14 through turn 22. Point 14 connects to pad 34 (connection point 15) through vias 40 and 36 (and a connection on another level (not shown).

Figure 4A:
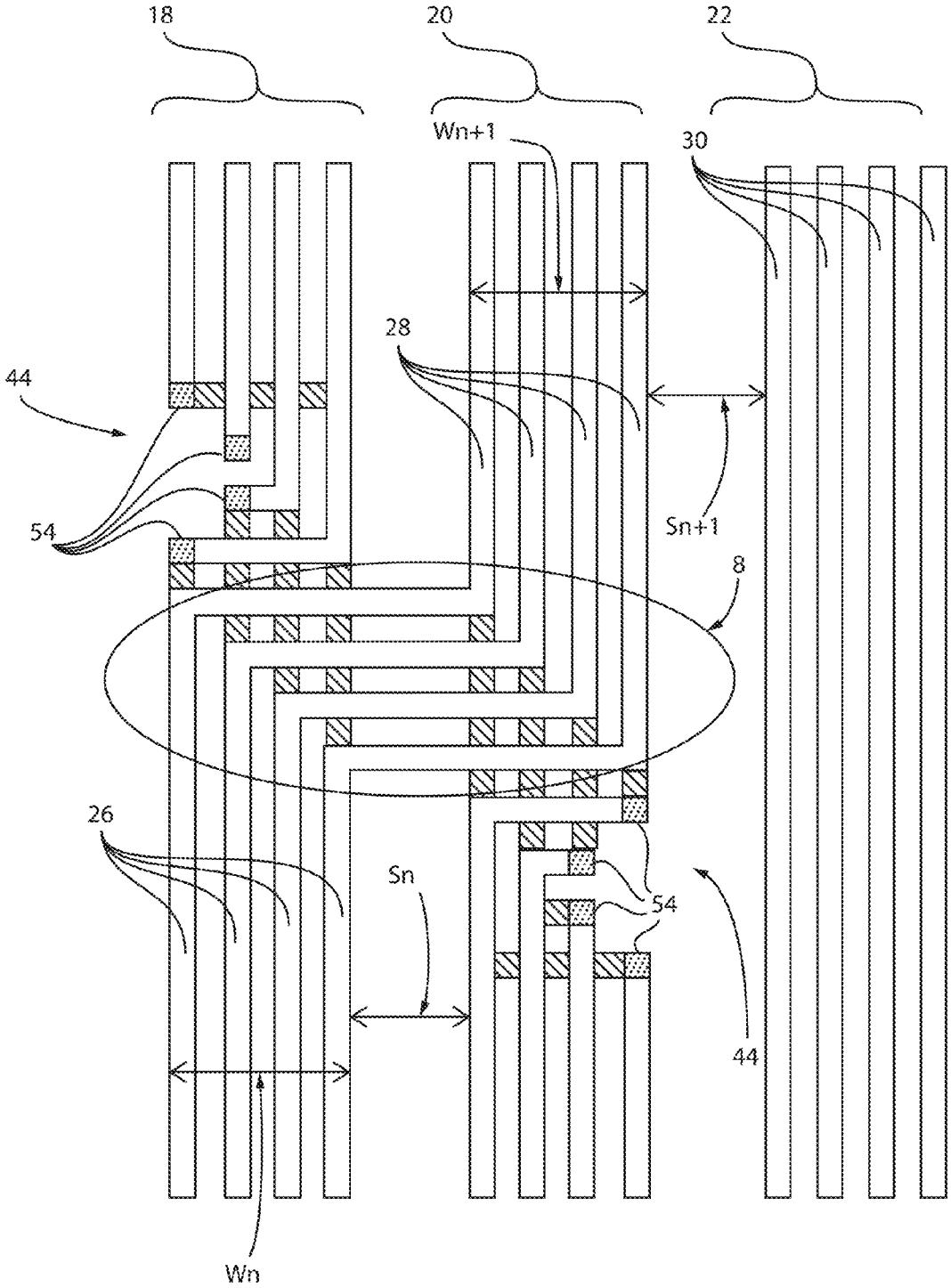
FIG. 4A is a partial layout view showing a turn-to-turn connection where the number of segments between turns is equal in accordance with the present principles.
Figure 4B:
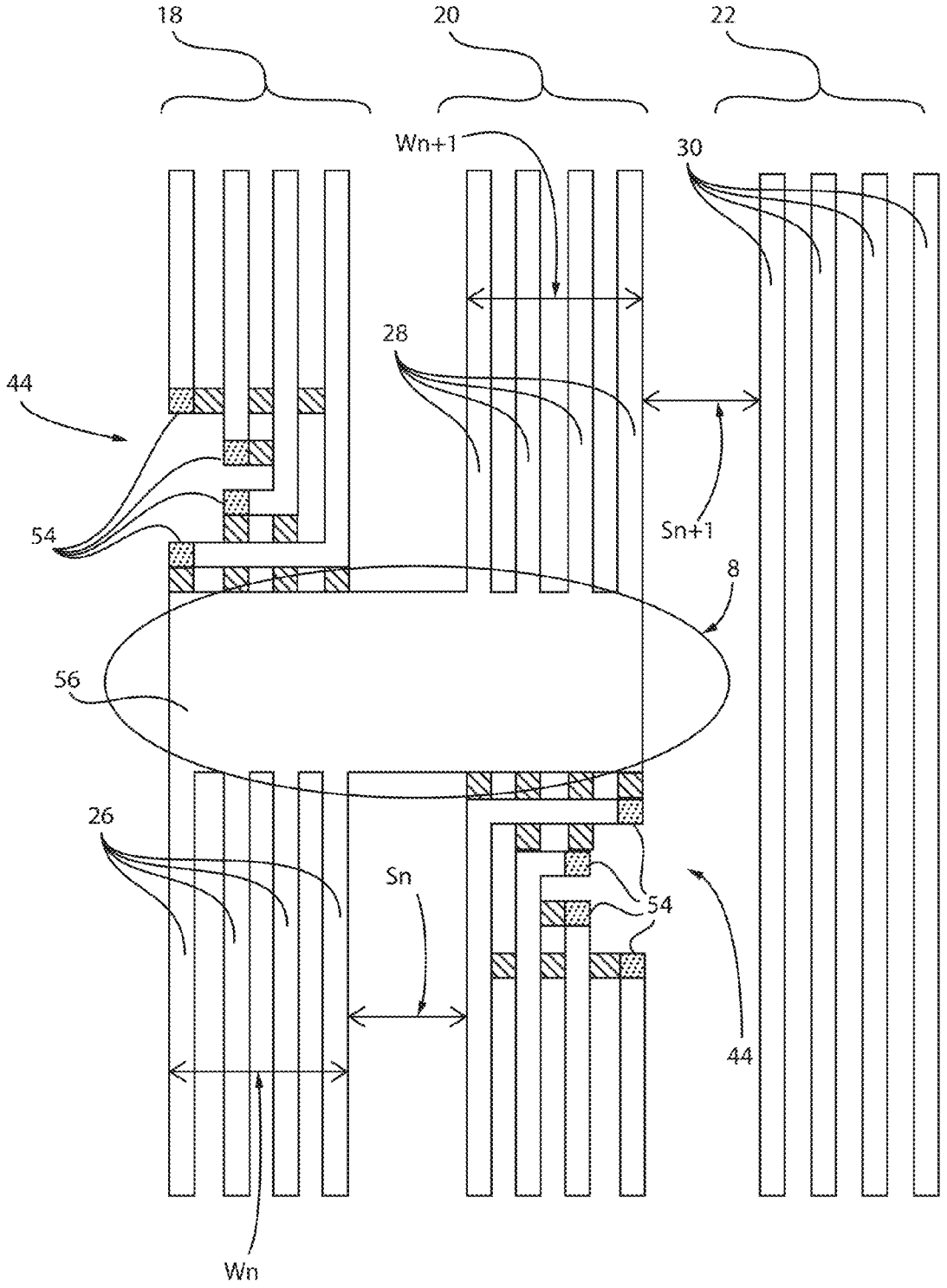
FIG. 4B is a partial layout view showing a turn-to-turn connection where the number of segments between turns is equal and connected in a block in accordance with the present principles.

Referring to FIGS. 4A-4D, turn-to-turn connections will be described in greater detail in accordance with four illustrative examples. The turn-to-turn connections occur, e.g., at points 5, 8, and 11 in FIG. 3. FIG. 4A shows the case where the number of segments (equal to 4) is the same between the turns before and after point 8. The segments 26 continue through the connection to segments 28. A width of turn 18 is indicated as Wn and the width of turn 20 is indicated as Wn+1. Similarly, a space between turn 18 and turn 20 is indicated as Sn and the next space between turn 20 and turn 22 is indicated as Sn+1. Nearby crossover architectures 44 are shown with vias 54 connecting layer 17 to layer 25. FIG. 4B shows the same case, but the segments are all shorted together (formed in a block 56) as they make the turn to turn connection.

Figure 4C:
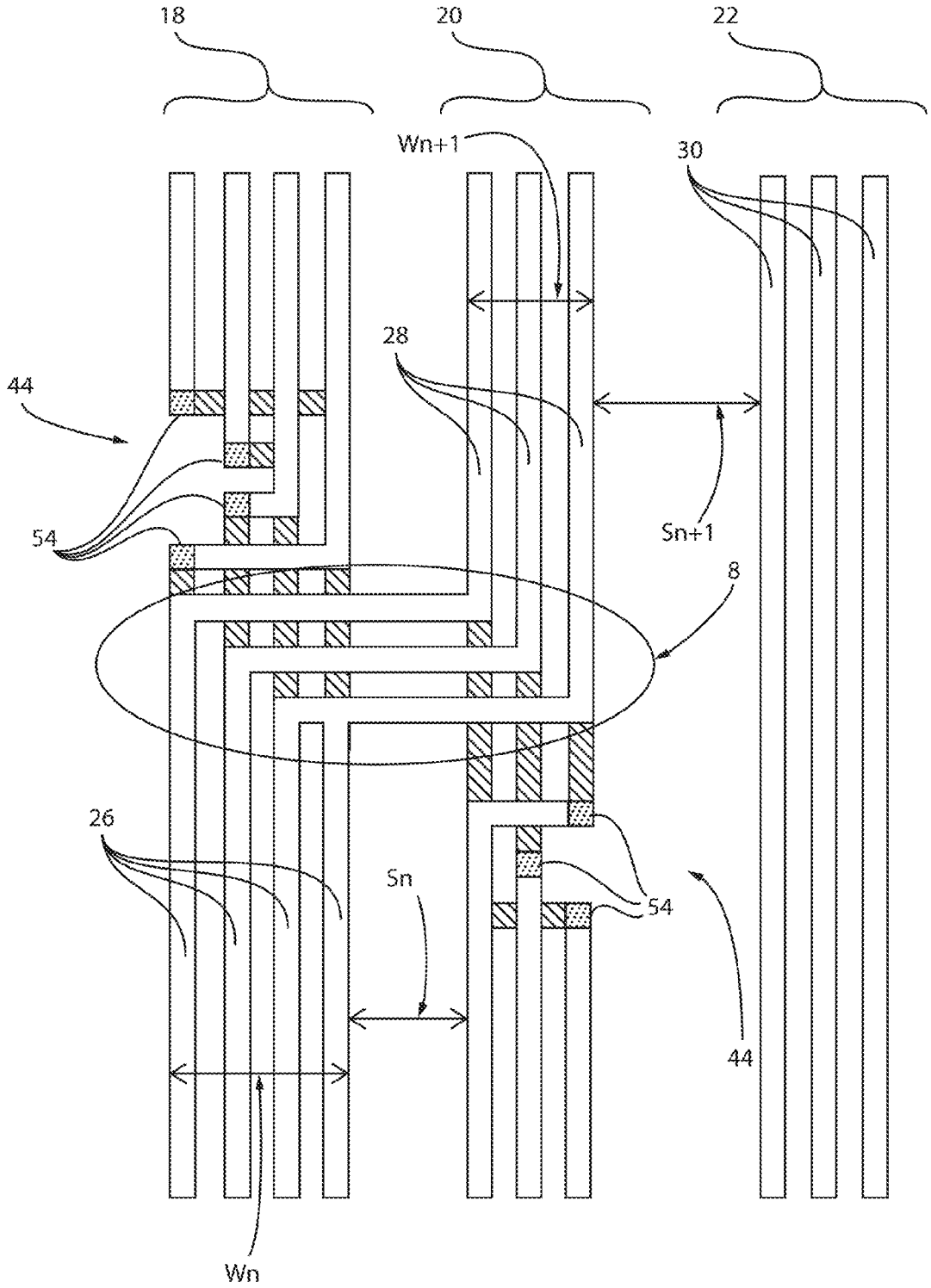
FIG. 4C is a partial layout view showing a turn-to-turn connection where the number of segments between turns is not equal in accordance with the present principles.
Figure 4D:
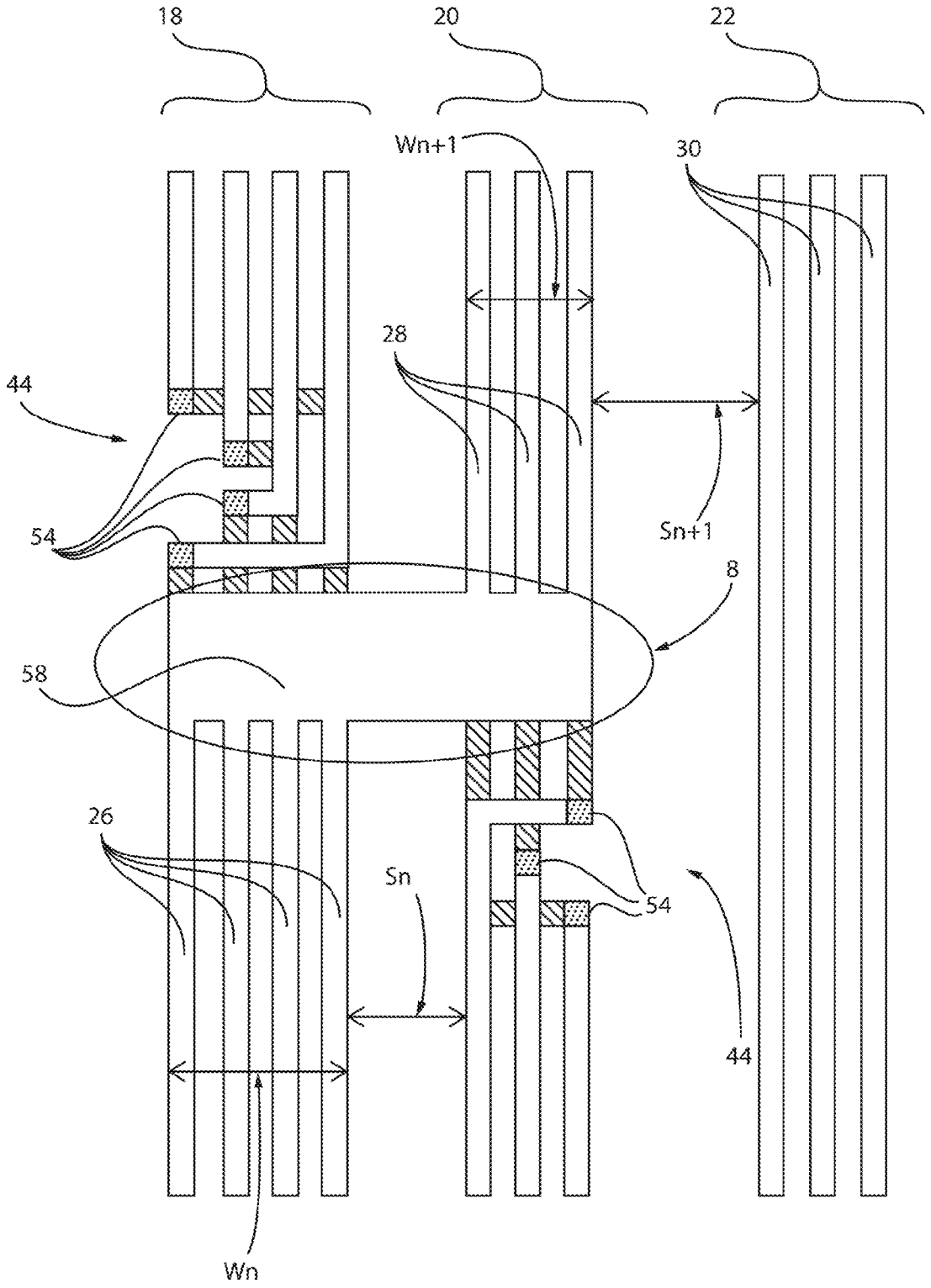
FIG. 4D is a partial layout view showing a turn-to-turn connection where the number of segments between turns is not equal and the segments are connected in a block in accordance with the present principles.

FIG. 4C shows the case where the number of segments is reduced in the next adjacent turn following connection point 8. This causes the turn width of the following turn to decrease from Wn to Wn+1 and the turn to turn space to increase from Sn to Sn+1. FIG. 4D shows the same case, but the segments are all shorted together to form block 58 as they make the turn-to-turn connection.

Figure 5:
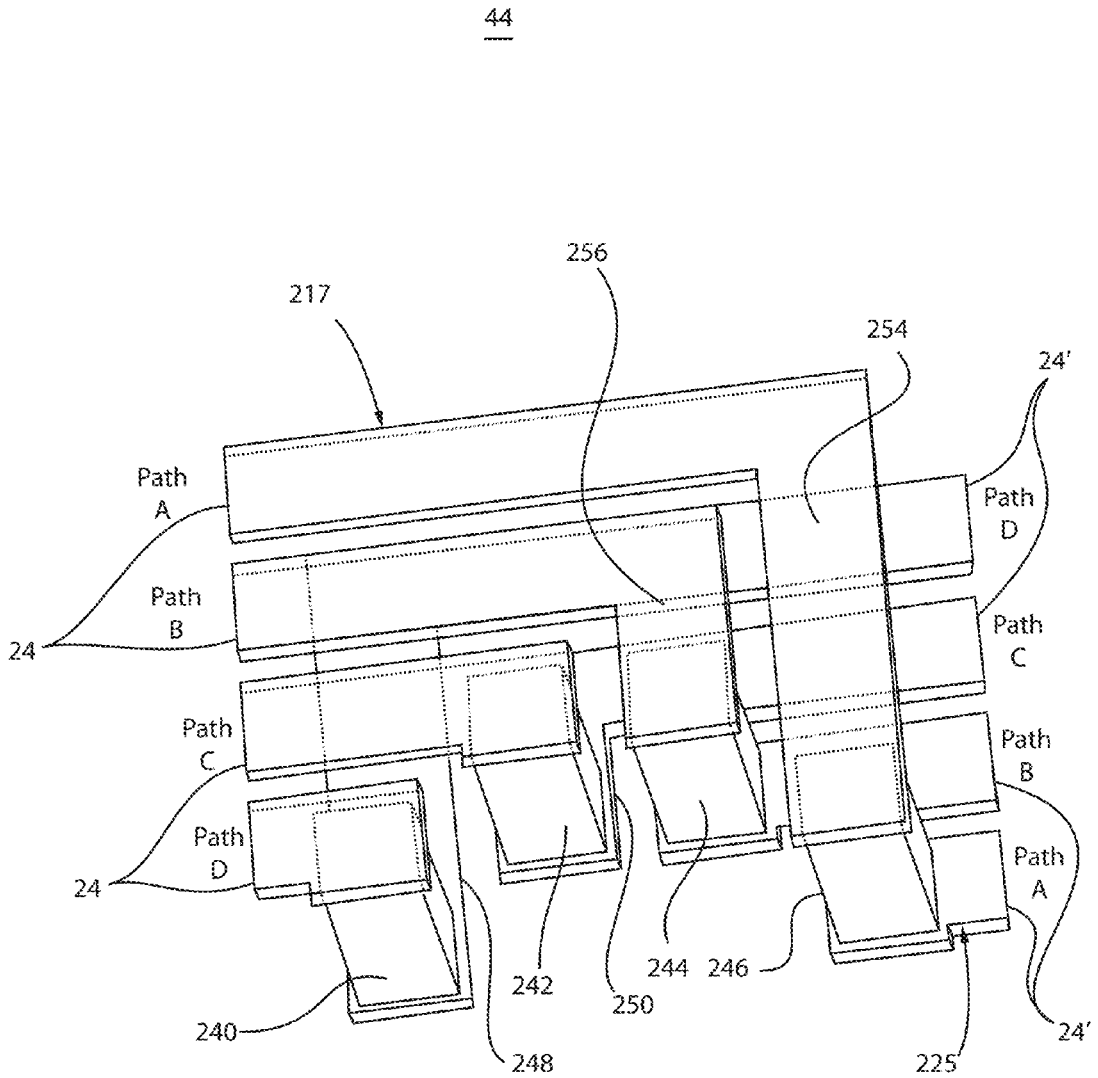
FIG. 5 is a perspective view of a cross-over architecture in accordance with the present principles.

Referring to FIG. 5, a cross-over architecture 44 is shown between connection point 3 and connection point 4 as described with reference to FIG. 3. Segments 24 of turn 16 on level 217 are connected to segments 24' of turn 16' on level 225. The outermost segment 24 connects to the innermost segment 24' through a lateral extension 254 and a via 246 to form path A. Path B includes an outer intermediary segment 24 connected to an inner intermediary segment 24' by a lateral extension 256 and a via 244. Path C includes an inner intermediary segment 24 connected to an outer intermediary segment 24' by a via 242 and a lateral extension 250. Path D includes an inner segment 24 connected to an outer segment 24' by a via 240 and a lateral extension 248.

By employing, the cross-over architecture including vias, extensions and segment lengths, segment pairs for a given turn are equal in length. For example, a length of path A=length of path B=length of path C=length of path D.

Referring to FIGS. 6A-6E, cross-sections of a 3D inductor structure are shown having an upper layer 302 and a lower layer 304. The layers 302 and 304 comprise segment pairs as described above to equalize the current flow through each segment pair. Each segment pair is connected using the cross-over architecture (not shown) described above using multiple metal levels to enable lateral connection of segments without shorting segments together. For example, each spiral turn 306 is divided into multiple segments 308 connected in a solenoidal manner through the two or more vertical layers 302, 304, with the number of segments being reduced from outer turn to inner turn. The layers 302 and 304 in FIGS. 6A-6E have corresponding geometries (segments to segment and turn-to-turn correspondence).

Figure 6A:
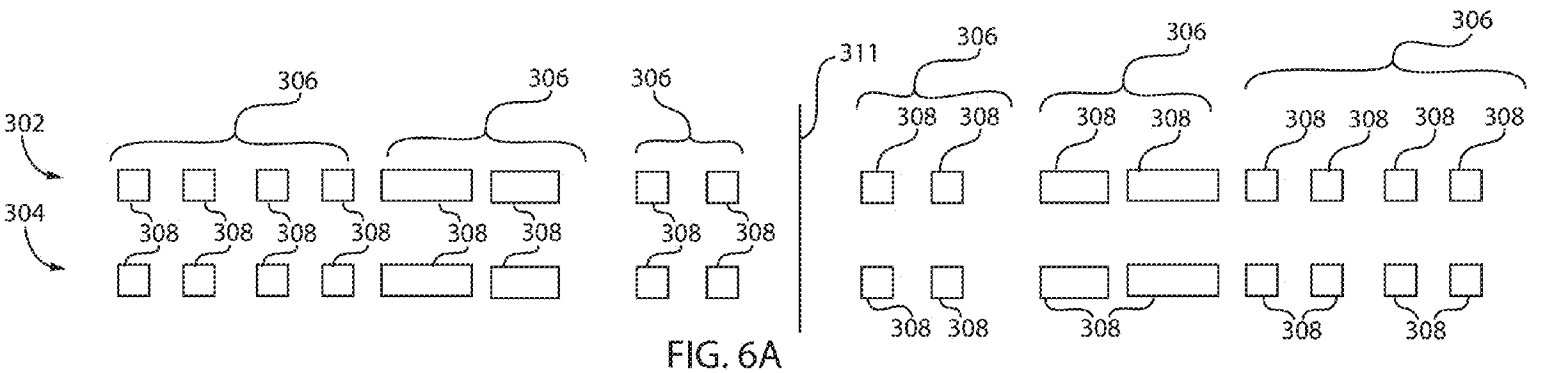
FIG. 6A is a schematic cross-sectional view showing a 3D inductor structure having an upper layer and a lower layer with segments varying in size and number as a function of radial distance from a center region in accordance with the present principles.

In FIG. 6A, a total width or the diameter of the spiral turns 306 and/or segments 308 may be reduced or increased at a constant rate or any other monotonic rate (including periodically constant) as the radius is reduced or increased relative to a center portion of a coil 311. In one embodiment, the segments vary in size and number as a function of radial distance from a center region.

Figure 6B:
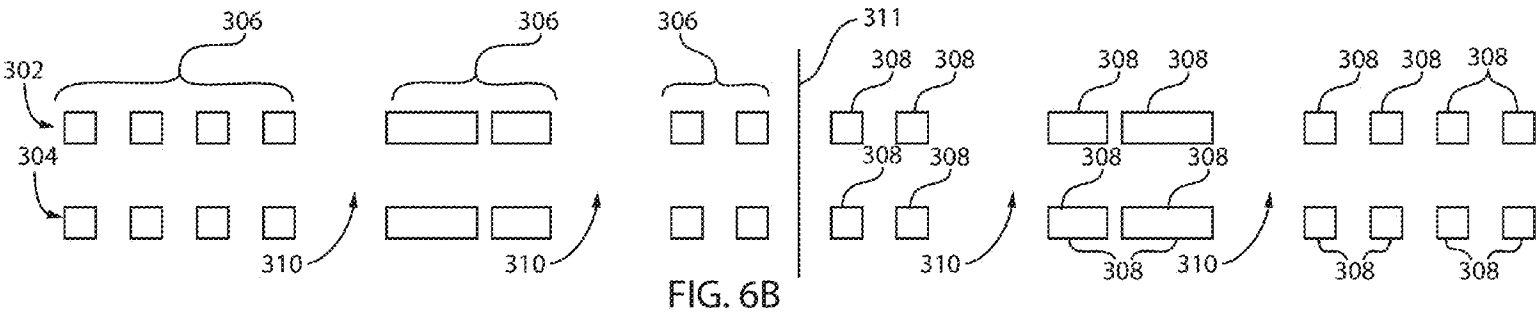
FIG. 6B is a schematic cross-sectional view showing a 3D inductor structure having an upper layer and a lower layer with turn or segment spacings varying in size as a function of radial distance from a center region in accordance with the present principles.

In FIG. 6B, spaces 310 between each consecutive spiral turns and/or segments 308 may be increased or reduced at a constant rate or any other monotonic rate (including periodically constant) as the radius is reduced or increased relative to a center portion of the coil 311.

The spacings and size (widths and/or thickness) of turns or segments can be modified as desired. For example, the spacing between segments within a turn can be increased while the total turn width can be decreased, maintaining a constant low frequency inductance and resistance, to further enhance high frequency performance.

Figure 6C:
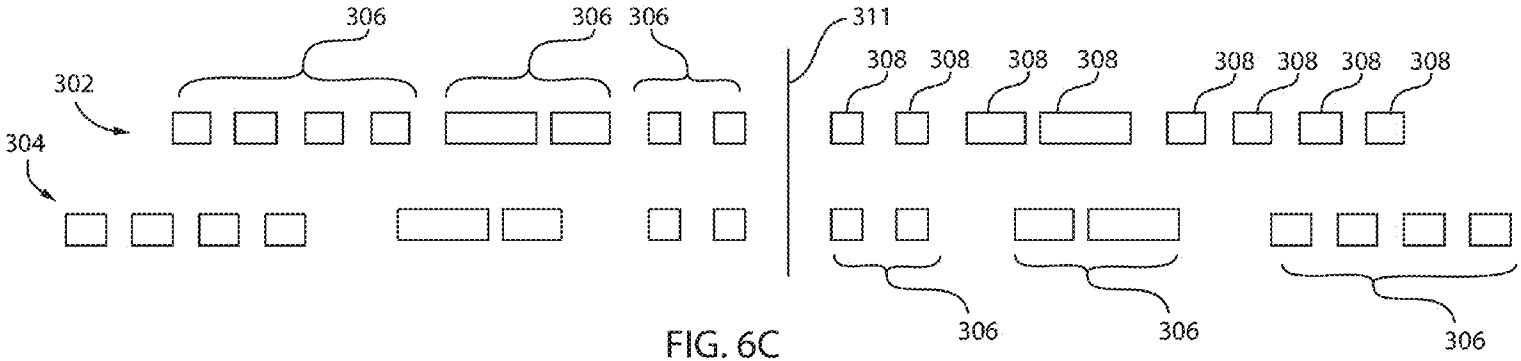
FIG. 6C is a schematic cross-sectional view showing a 3D inductor structure having an upper layer and a lower layer with spiral size varying between the two layers in accordance with the present principles.

In FIG. 6C, a width or spacing of one of the layers 302, 304 can be made significantly different from an adjacent spiral layer 304, 302 without disturbing the overall inductor structure.

Figure 6D:
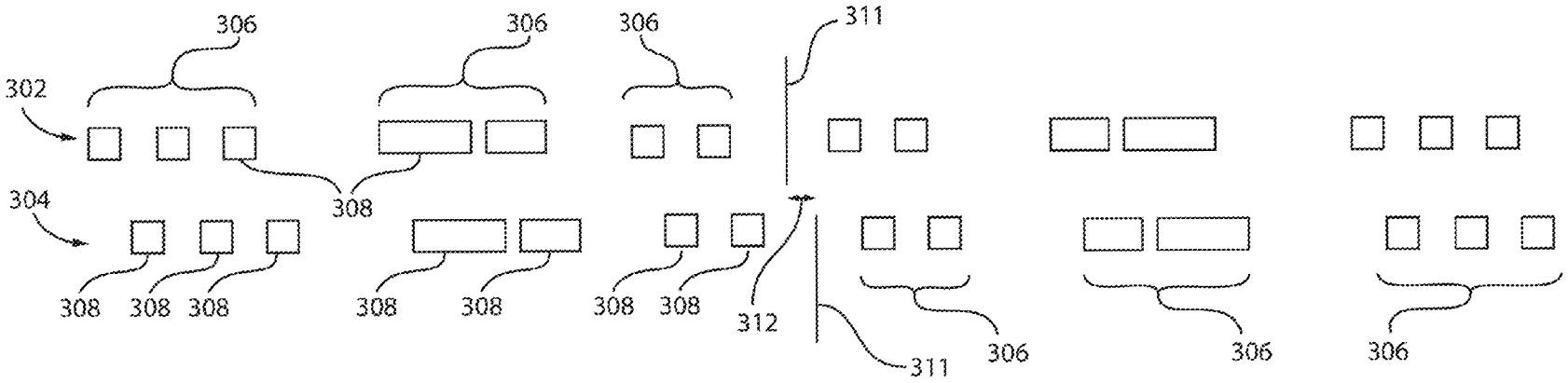
FIG. 6D is a schematic cross-sectional view showing a 3D inductor structure having an upper layer and a lower layer horizontally offset from each other in accordance with the present principles.

In FIG. 6D, one of the upper and lower spiral layers 302, 304 can have a horizontal offset 312 relative to the other (e.g., instead of being perfectly aligned vertically to each other).

Figure 6E:
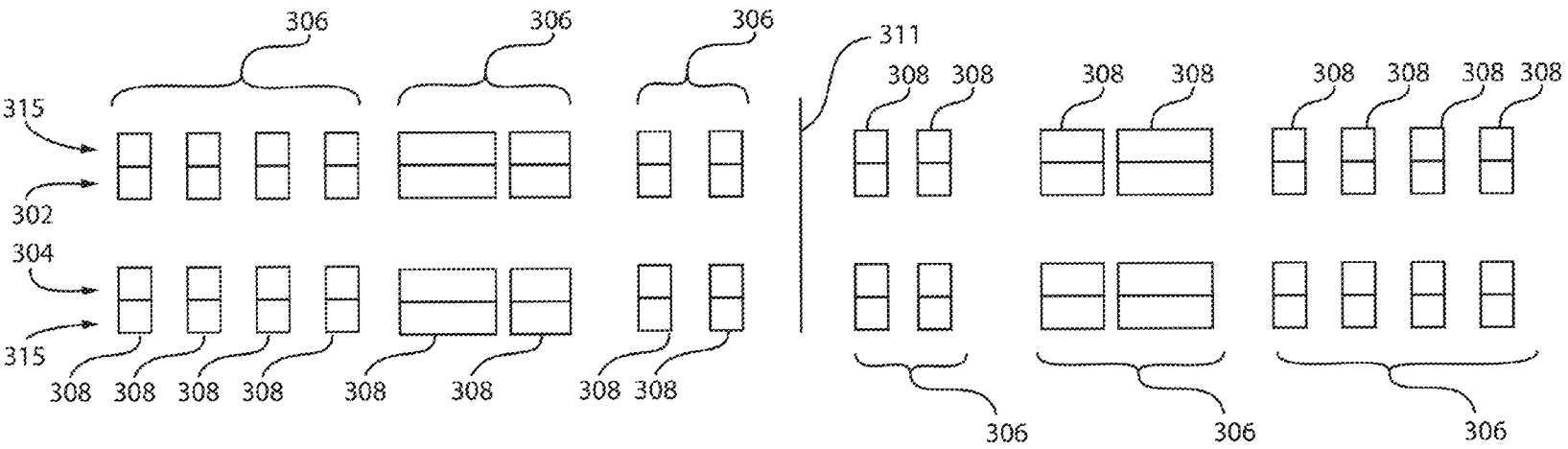
FIG. 6E is a schematic cross-sectional view showing a 3D inductor structure having an upper layer and a lower layer each with an additional metal layer to reduce resistance in accordance with the present principles.

In FIG. 6E, one or more vertically adjacent metal layers 315 can be connected in parallel to the upper or lower spirals to decrease series resistance. The additional metal layer may include an increased thickness, an additional patterned metal layer in contact with the upper or lower spirals or interlevel connects (interconnects or vias) connecting one or more additional spiral layers.

Figure 7A:
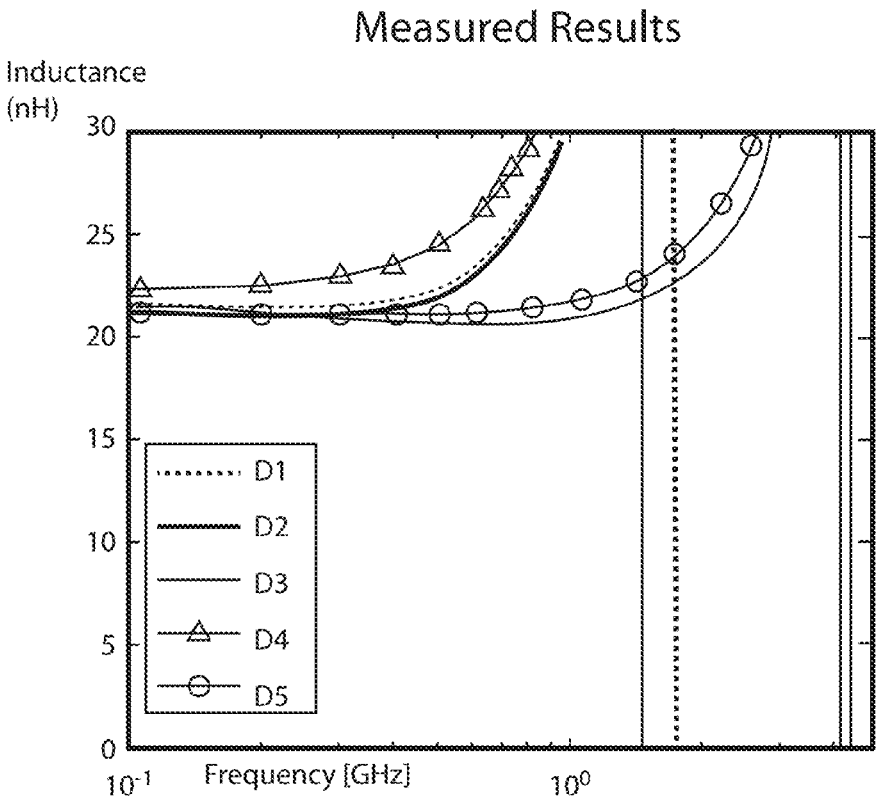
FIG. 7A is a graph of inductance (nH) versus frequency (GHz) for five inductor structures showing improved inductor characteristics in accordance with the present principles.

Referring to FIG. 7A, a graph of inductance (nH) versus frequency (GHz) is plotted for five inductor structures. These structures include: D1—a conventional series stacked inductor (Width (W)=25 microns, Space (S)=5 microns, N=8, Area=330×500 microns$^2$); D2—a conventional series stacked inductor with a varied width and space (W=25 microns, 15 microns, S=5 microns, 10 microns, N=8, Area=330×500 microns$^2$); D3—solenoidal series stacked inductor (W=25 microns, S=5 microns, N=8, Area=330×500 microns$^2$); D4—conventional series stacked inductor with a multipath architecture (W=25 microns, S=5 microns, N=8, Area=330×500 microns$^2$); and D5—an inductor in accordance with the present principles including cross-over architectures, solenoidal winding, and varied width and space (W=25 microns, 15 microns, S=5 microns, 10 microns, N=8, Area=330×500 microns$^2$).

The D5 structure provides a steady inductance value over a large frequency range. While D3 provides a similar response, the quality factor for D3 is very low as compared to the quality factor of D5. (See FIG. 7B).

Figure 7B:
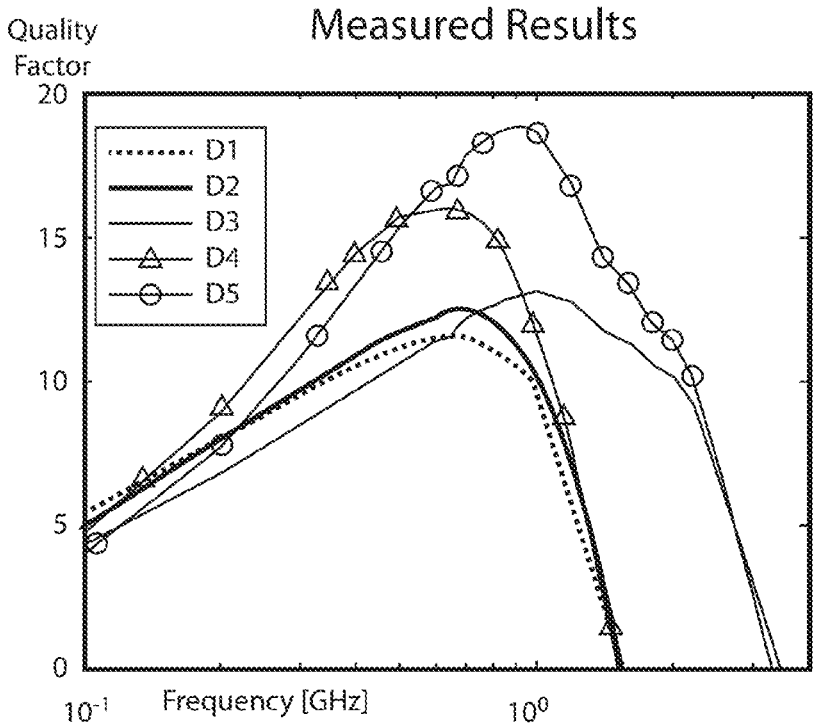
FIG. 7B is a graph of quality factor versus frequency (GHz) for five inductor structures showing improved quality factor in accordance with the present principles.

Referring to FIG. 7B, a graph of quality factor versus frequency (GHz) is plotted for the five inductor structures described above. These structures were formed using a four layer metal stack on a silicon-on-insulator (SOI) substrate. The quality factor for the D5 structure in accordance with the present principles is higher than the other structures and remains so over a larger frequency range.

The structures in accordance with the present principles provide a high inductance density, higher quality factor, higher self-resonance frequency and measured results support significant improvements in inductor performance. The 3D inductor structure in accordance with the present principles provides a solenoidal winding that provides higher self-resonance frequency, includes a multipath architecture with cross-overs for equal path length to reduce skin effect and proximity effect losses and includes variable segments within each turn (segment pairs) to further reduce proximity effect losses. Structures in accordance with the present principles may be implemented with all back end of the line (BEOL) processing options. The inductor structures may be employed in any semiconductor device or chip that includes or needs an inductor and, in particularly useful embodiments, the present principles provide inductors for high frequency applications such as communications applications, e.g., in GSM and CDMA frequency bands, amplifiers, power transfer devices, etc.

Figure 8:
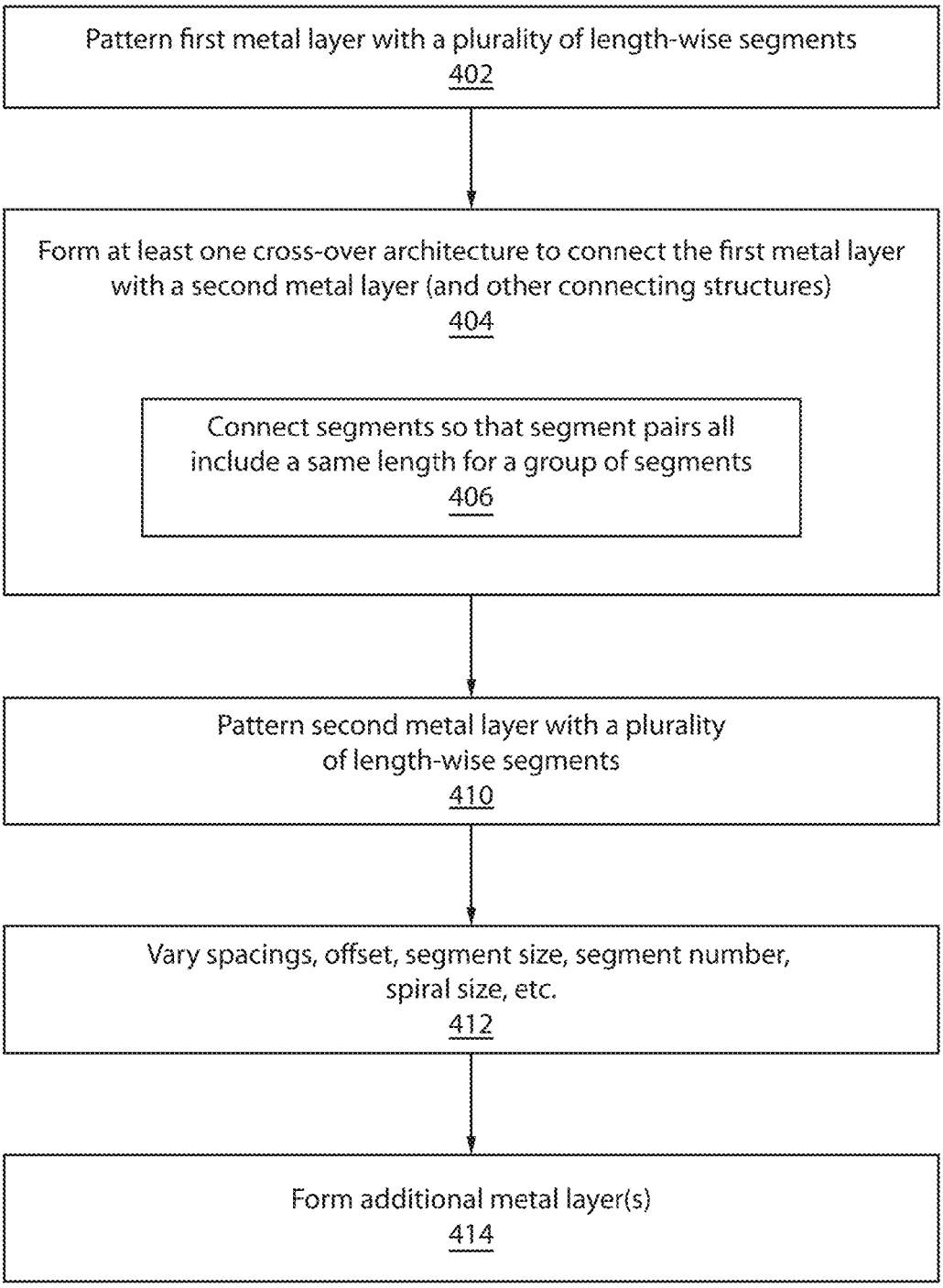
FIG. 8 is a block/flow diagram showing a method for fabricating a series stacked multipath inductor in accordance with illustrative embodiments.

Referring to FIG. 8, a method for fabricating a series stacked multipath inductor is shown in accordance with illustrative embodiments. It should be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In block 402, a first metal layer is patterned to form spiral turns about a center region. The patterning process may employ any known process including lithographic masking and etching, lithographic trench formation, metal deposition and chemical mechanical planarization, etc. The spiral turns include two or more segments that extend length-wise along the turns and have positions that vary from an innermost position relative to the center portion and an outermost position relative to the center portion. In block 404, at least one cross-over architecture is formed and configured to couple the segments of the first layer to the segments of a second layer to form segment paths that have a substantially same length for all segment paths between the first layer and the second layer. One or more cross-over architectures may be employed per turn. The cross-over architectures may be formed by via connections (and/or other structures, e.g., extensions, bars, connection lines, etc.) formed through a dielectric layer. The dielectric layer may be deposited over the first metal layer and via holes may be opened up to connect to segments as described above.

Forming at least one cross-over architecture includes forming segment pairs between layers that have a substantially same length in block 406. This may be achieved by connecting a segment on the first layer at an innermost position to a segment on the second layer at an outermost position, and a segment on the first layer at an outermost position to a segment on the second layer at an innermost position. If present, a segment on the first layer is connected at an inner intermediary position to a segment on the second layer at an outer intermediary position, and a segment on the first layer at an outer intermediary position is connected to a segment on the second layer at an inner intermediary position.

In block 410, the second metal layer is patterned to form spiral turns about the center region and is vertically offset from the first metal layer. The patterning may include any known process. The spiral turns include two or more segments that extend length-wise along the turns and have positions that vary from an innermost position relative to the center portion and an outermost position relative to the center portion, the first layer and the second layer preferably including corresponding geometry therebetween. The corresponding geometry preferably includes an equal number of segments that have a positional relationship with segments of other levels.

Note that the shape and geometry, such as, spiral offsets, spiral size, turn spacings, segment size or number (e.g., thickness/widths or number of segments in a turn, etc.) may be varied in block 412, as described above. For example, the first metal layer or the second metal may be patterned to include a segment number that varies with distance from the center region.

In block 414, additional layers or structures (e.g., vias, extensions, connections, etc.) may be added and connected by cross-over architectures or be included by connections to increase conductive cross-section and reduce resistance.

Having described preferred embodiments for a solenoidal series stacked multipath inductor (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A series stacked, solenoidally wound, multipath inductor, comprising:

a plurality of turns disposed about a center region on a first layers, and a second plurality of turns on a second layer the turn on the first and second layers-having corresponding geometry therebetween;

each of the turn of the first plurality of turns and the second plurality of turns including two or more segments within the respective turn that extends length-wise along the respective turn, the segments within each turn having positions that vary from an innermost position within the respective turn relative to the center region and an outermost position within the respective turn relative to the center region; and at least one cross-over architecture configured to couple the segments of a turn of the first plurality of turns with the segments of a corresponding turn of the second plurality of turns to form segment paths that have a substantially same length for all segments paths in a grouping of segment paths between the first layer and the second layer.

2. The inductor as recited in claim 1, wherein the at least one cross-over architecture includes a connection between a segment on the first layer at an innermost position within the respective turn is connected to a segment on a second layer at an outermost position within the respective turn, and a segment on the first layer at an outermost position within the respective turn is connected to a segment on the second layer at an innermost position of the respective turn.

3. The inductor as recited in claim 1, wherein the at least one cross-over architecture includes a connection between a segment of the turn of the first plurality of turns on a first layer at an inner intermediary position within the respective turn and a segment of the corresponding turn of the second plurality of turns on a second layer at an outer intermediary position, and a connection between a segment of the turn of the first plurality of turns on the first layer at an outer intermediary position within the respective turn is connected to a segment of the corresponding turn of the second plurality of turns on the second layer at an inner intermediary position within the respective turn.

4. The inductor as recited in claim 1, wherein the at least one cross-over architecture includes a connection between a middle segment of the turn of the first plurality of turns on a first layer is connected to a middle segment of the corresponding turn of the second plurality of turns on a second layer.

5. The inductor as recited in claim 1, wherein the at least one cross-over architecture includes lateral extensions and vias to form connections between the two or more segments.

6. The inductor as recited in claim 1, wherein the at least one cross-over architecture includes one or more cross-over architectures per turn to equalize current flow through each segment.

7. The inductor as recited in claim 1, wherein the turns include a width that varies with distance from the center region.

8. The inductor as recited in claim 1, wherein the turns include a spacing that varies with distance from the center region.

9. The inductor as recited in claim 1, wherein the turns include a segment number that varies with distance from the center region.

10. The inductor as recited in claim 1, wherein the corresponding geometries of the first plurality of turns and the second plurality of turns are horizontally offset from one another.

11. The inductor as recited in claim 1, further comprising at least one additional layer coupled electrically in parallel to one or more of the first layer and the second layer to reduce resistance.

12. A series stacked, solenoidally wound, multipath inductor, comprising:

a first metal layer being patterned to form first plurality of spiral turns including a first spiral turn and a second spiral turn about a center region, each spiral turn in the plurality of spiral turns including two or more segments that extend length-wise along the spiral turns and the two or more segments having positions that vary from an innermost position within the respective spiral turn relative to the center region to an outermost position within the respective spiral turn relative to the center region;

a second metal layer being patterned to form a second plurality of spiral turns including a third spiral turn and a fourth spiral turn about the center region and being vertically offset from the first metal layer, each spiral turn in the plurality of spiral including two or more segments that extend length-wise along the spiral turns and the two or more segments having positions that vary from an innermost position within the respective spiral turn relative to the center region to an outermost position within the respective spiral turn relative to the center region, the first layer and the second layer including corresponding geometry therebetween; and at least one cross-over architecture configured to couple the segments of each spiral turn on the first layer to the segments of the corresponding spiral turn on the second layer to form segment paths that have a substantially same length for all segment paths in a grouping of segment paths between the first layer and the second layer, wherein the at least one cross-over architecture includes a first cross-over architecture coupling the two or more segments of the first spiral turn of the first metal layer to the two or more segments of the segments of the third spiral turn of the second metal layer.

13. The inductor as recited in claim 12, wherein the first cross-over architecture includes a connection between a segment within the first spiral turn of the plurality of spiral turns on the first layer at an innermost position within the first spiral turn to a segment within the corresponding spiral turn of the plurality of spiral turns on the second layer at an outermost position within the corresponding spiral turn, and a segment within the first spiral turn on the first layer at an outermost position within the first spiral turn to a segment within the corresponding spiral turn on the second layer at an innermost position within the corresponding spiral turn.

14. The inductor as recited in claim 12, wherein the cross-over architecture includes a connection between a segment within the first spiral turn of the plurality of spiral turns on the first layer at an inner intermediary position within the first spiral turn to a segment within the corresponding spiral turn of the plurality of spiral turns on the second layer at an outer intermediary position within the corresponding spiral turn, and a segment within the first spiral turn on the first layer at an outer intermediary position within the first spiral turn to a segment within the corresponding spiral turn on the second layer at an inner intermediary position within the corresponding turn.

15. The inductor as recited in claim 12, wherein the first cross-over architecture includes a connection between a middle segment within the first spiral turn of the plurality of spiral turns on the first layer to a middle segment within the corresponding spiral turn of the plurality of spiral turns on a second layer.

16. The inductor as recited in claim 12, wherein the at least one cross-over architecture includes lateral extensions and vias to form connections between two or more segments.

17. The inductor as recited in claim 12, wherein the at least one cross-over architecture includes one or more cross-over architectures per turn to equalize current flow through each segment.

18. The inductor as recited in claim 12, wherein the turns include one or more of: a width that varies with distance from the center region; a spacing that varies with distance from the center region and/or a segment number that varies with distance from the center region.

19. The inductor as recited in claim 12, wherein the corresponding geometries of the first and second layers are offset horizontally from one another.

20. The inductor as recited in claim 12, further comprising at least one additional layer coupled to one of the first or second layers to reduce resistance.

21. A series stacked, solenoidally wound, multipath inductor, comprising:

a first metal layer being patterned to form a first spiral turn and a second spiral turn about a center region, each spiral turn including two or more segments that extends length-wise along the spiral turns and the two or more segments having positions that vary from an innermost position within the respective spiral turn relative to the center region to an outermost position within the respective spiral turn relative to the center region, and wherein the first spiral turn includes an outermost segment relative to the center region and the second spiral turn includes an innermost segment relative to the enter region;

a second metal layer being patterned to form a third spiral turn and a fourth spiral turn about the center region and being vertically offset from the first metal layer, each spiral turn in the plurality of spiral including two or more segments that extend length-wise along the spiral turns and the two or more segments having positions that vary from an innermost position within the respective spiral turn relative to the center region to an outermost position within the respective spiral turn relative to the center region, the first layer and the second layer including corresponding geometry therebetween, and wherein the third spiral turn includes an outermost segment relative to the center region and the fourth spiral turn includes an innermost segment relative to the center region;

a first cross-over architecture coupling the two or more segments of the first spiral turn of the first metal layer to the two or more segments of the third spiral turn of the second metal layer to form segment paths that have a substantially same length for all segment paths in a grouping of segment paths between the first layer and the second layer; and a second cross-over architecture coupling the two or more segments of the second spiral turn of the first metal layer to the two or more segments of the third spiral turn of the second metal layer to form segment paths that have a substantially same length for all segment paths in a grouping of segment paths between the first layer and the second layer.

* * * * *